US006058862A

United States Patent [19]

Umeda et al.

[11] Patent Number: 6,058,862

[45] Date of Patent: May 9, 2000

[54] LINK-MEMBER SWINGING APPARATUS

[75] Inventors: Kazutoshi Umeda, Tokai; Eiichi Ohta, Chita; Hiroyuki Suzuki, Kasugai; Kohtaro Miyazaki, Tajimi, all of Japan

[73] Assignee: Brother Kogyo Kabushiki Kaisha, Nagoya, Japan

[21] Appl. No.: 09/197,501

[22] Filed: Nov. 23, 1998

[30] Foreign Application Priority Data

Nov. 27, 1997 [JP] Japan ..... 9-343958

[51] Int. Cl.[7] ..... D05B 3/02

[52] U.S. Cl. ..... 112/443

[58] Field of Search ..... 112/157, 443, 112/459, 460, 466, 464, 284, 220, 221

[56] References Cited

U.S. PATENT DOCUMENTS

| | | | |
|---|---|---|---|
| 2,883,951 | 4/1959 | Amman | 112/459 X |
| 2,969,756 | 1/1961 | Eriksson | 112/460 |
| 2,972,319 | 2/1961 | Moro | 112/460 |
| 3,313,258 | 4/1967 | Wulbrede et al. | 112/443 |
| 3,332,380 | 7/1967 | Yanagibayashi | 112/466 |
| 4,569,299 | 2/1986 | Vogel | 112/464 X |

*Primary Examiner*—Ismael Izaguirre
*Attorney, Agent, or Firm*—Oliff & Berridge, PLC.

[57] ABSTRACT

A link-member swinging apparatus for reciprocatively swinging a link member while keeping a fulcrum portion of the link member at substantially a predetermined location, including an actuator which is operatively connected to an input portion of the link member, the input portion of the link member being distant from the fulcrum portion thereof in a lengthwise direction of the link member, and a supporting device which elastically supports the fulcrum portion of the link member, while permitting the fulcrum portion to be elastically moved from a reference position thereof in a direction intersecting the lengthwise direction of the link member.

22 Claims, 12 Drawing Sheets

10

LINK-MEMBER SWINGING APPARATUS

BACKGROUND OF THE INVENTION

1. Field of the Invention

The present invention relates to a link-member swinging apparatus which includes an actuator for swinging a link member.

2. Related Art Statement

There is known a reciprocating apparatus which is employed in each of various sorts of mechanical drive systems and which reciprocates a drive lever or a drive shaft belonging to the each drive system. For example, FIG. 12 shows a known reciprocating apparatus 110 which includes a stepper motor 112 as an electric actuator; a drive gear 114 fixed to an output shaft of the motor 112; a sector gear 118 meshed with the drive gear 114; and a drive shaft 116 which belongs to a mechanical drive system and which is fixed to the sector gear 118, or a drive lever 119 which belongs to a mechanical drive system and which is pivotally connected to one end portion of the sector gear 118. The stepper motor 112 is first rotated clockwise, subsequently is stopped for a very short time, then is rotated counterclockwise, and is stopped again for a very short time, and those actions are repeated. Thus, the stepper motor 112 reciprocates the drive lever 119 or the drive shaft 116 via the sector gear 118.

In the case where the mechanical drive system to which the drive lever 119 or the drive shaft 106 belongs has a great mass, i.e., a great inertia, when the sector gear 118 is stopped after being rotated, e.g., clockwise by the stepper motor 112, the stepper motor 112 is subjected to impact or vibration due to the great inertia of the drive system via the sector gear 118. In particular, in the case where the drive lever 119 of the reciprocating apparatus 110 laterally reciprocates, e.g., a needle bar of a zigzag sewing machine, at a high speed, the stepper motor 112 is subjected to a great impact or a large vibration due to the great inertia of the drive system including the needle bar. This leads to unstable stitch positions where a sewing needle attached to the needle bar penetrates a work-sheet such as a febric or a leather, or unstable sewing widths over which the needle is laterally reciprocated. Thus, irregular zigzag stitches are formed on the work-sheet. In addition, when the stepper motor 112 is rotated in the opposite direction a very short time after being stopped, the motor 112 may loose its synchronism.

The above problems may be solved by keeping the stepper motor 112 stopped for a long time sufficient for the vibration thereof resulting from the stopping thereof to dissipate substantially completely. In this case, however, the speed of lateral reciprocation of the needle bar cannot, be increased.

Meanwhile, it has been practiced to minimize the vibration of the stepper motor 112 at the time of being stopped, by applying permanently a certain frictional resistance to the mechanical drive system, or applying a certain additional load to reduce the vibration of the motor 112. In either case, however, the stepper motor 112 must be a larger-size one which can produce an additional torque to bear the frictional resistance or the additional load. This leads to increasing the production cost of the zigzag sewing machine.

SUMMARY OF THE INVENTION

It is therefore an object of the present invention to provide a link-member swinging apparatus which quickly absorbs vibration of a link member when the swinging of the link member is stopped, and which has a simple construction.

It is another object of the present invention to provide a sewing machine including the above link-member swinging apparatus.

It is another object of the present invention to provide a swing-link apparatus which quickly absorbs vibration of a swing link when the swinging of the swing link is stopped.

It is another object of the present invention to provide a reciprocal apparatus which quickly absorbs vibration of a reciprocative member when the reciprocation of the reciprocative member is stopped.

It is another object of the present invention to provide a zigzag sewing machine which quickly absorbs vibration of a needle bar when the reciprocation of the needle bar is stopped.

The present invention provides a link-member swinging apparatus, a sewing machine, a swing-link apparatus, a reciprocal apparatus, and a zigzag sewing machine which have one or more of the technical features that are described below in respective paragraphs given parenthesized sequential numbers (1) to (22). Any technical feature which includes another technical feature shall do so by referring, at the beginning, to the parenthesized sequential number given to that technical feature. Thus, two or more of the following technical features may be combined, if appropriate. Each technical feature may be accompanied by a supplemental explanation, as needed. However, the following technical features and the appropriate combinations thereof are just examples to which the scope of the present invention is by no means limited.

(1) According to a first feature of the present invention, there is provided a link-member swinging apparatus for reciprocatively swinging a link member while keeping a fulcrum portion of the link member at substantially a predetermined location, comprising an actuator which is operatively connected to an input portion of the link member, the input portion of the link member being distant from the fulcrum portion thereof in a lengthwise direction of the link member; and a supporting device which elastically supports the fulcrum portion of the link member, while permitting the fulcrum portion to be elastically moved from a reference position thereof in a direction intersecting the lengthwise direction of the link member. The supporting device may be one which elastically supports the fulcrum portion of the link member, while permitting the fulcrum portion to be elastically moved from the reference position thereof in the lengthwise direction of the link member. The actuator may be provided by a stepper motor that can be precisely controlled with respect to its rotation position. The fulcrum portion of the link member is supported by the supporting device such that the link member is reciprocatively swung. When the actuator operatively connected to the input portion of the link member is repetitively operated forward and backward, the link member is reciprocatively swung. In the case where a connection lever of a mechanical drive system, such as a needle-bar reciprocating device or a work-sheet feeding device, is connected to a portion of the link member, the connection lever is reciprocatively moved by the link member that is reciprocatively swung by the actuator. Thus, the needle-bar reciprocating device accurately reciprocates a needle bar over a predetermined stroke, or the work-sheet feeding device accurately reciprocates a feed member over a predetermined stroke. When the swinging of the link member is stopped by the actuator between each of the repetitive forward movements of the link member and a following one of the repetitive backward movements of the same and/or between each of the repetitive backward movements of the link member and a following one of the repetitive forward movements of the same, the link member is subjected to the inertia force of the link member itself and the mechanical drive system, in a certain direction. Consequently the link member is caused to vibrate, i.e., slightly swing, about the fulcrum portion thereof. The supporting device permits the fulcrum portion of the link member to be elastically moved from its reference position, such that the portion of the link member to which the mechanical drive system is connected is substantially prevented from being vibrated. Thus, the needle bar or the feed member is substantially prevented from being vibrated. That portion of the link member may be one of lengthwise opposite end portions of the link member. Since the vibration of the link member is effectively prevented, the speed of swinging of the link member can be increased. In addition, according to the present invention, no additional load such as a friction resistance is applied to the link member, a small-size actuator may be employed in the present swinging apparatus. In the case where a stepper motor is employed as the actuator, the stepper motor is effectively prevented from loosing its synchronism.

(2) According to a second feature of the present invention that includes the first feature (1), the fulcrum portion of the link member comprises a bifurcate end portion, and the supporting device comprises a frame; an eccentric member which includes an axial portion which is pivotally supported by the frame such that the axial portion extends in a direction perpendicular to a swing plane in which the link member is reciprocatively swung; and an eccentric portion which is eccentric with an axis line of the axial portion and which is engaged with the bifurcate end portion of the link member such that the eccentric portion is fitted in an inner space of the bifurcate end portion; and a leaf spring whose one end portion is fixed to the axial portion of the eccentric member such that the leaf spring extends in a direction perpendicular to the axis line of the axial portion, and whose other end portion is engaged with the frame. When the swinging of the link member is stopped by the actuator, the eccentric portion of the eccentric member is rotated with the axial portion thereof by the bifurcate end portion of the link member. Consequently the leaf spring is elastically deformed. This elastic deformation of the leaf spring effectively prevents the vibration of the link member.

(3) According to a third feature of the present invention that includes the first feature (1), the fulcrum portion of the link member comprises a bifurcate end portion, and the supporting device comprises a frame having a hole; an eccentric member which includes an axial portion which is pivotally supported by the frame such that the axial portion extends in a direction perpendicular to a swing plane in which the link member is reciprocatively swung; and an eccentric portion which is eccentric with an axis line of the axial portion and which is engaged with the bifurcate end portion of the link member such that the eccentric portion is fitted in an inner space of the bifurcate end portion; and an annular elastic member which is fixed to an outer circumferential surface of the axial portion of the eccentric member and which is fixed to an inner circumferential surface of the hole of the frame. When the swinging of the link member is stopped by the actuator, the eccentric portion of the eccentric member is rotated with the axial portion thereof by the bifurcate end portion of the link member. Consequently the annular elastic member is elastically deformed in a circumferential direction thereof. This elastic deformation of the annular elastic member effectively prevents the vibration of the link member.

(4) According to a fourth feature of the present invention that includes the first feature (1), the fulcrum portion of the link member comprises a bifurcate end portion, and the supporting device comprises a frame having a hole; an eccentric member which includes an axial portion which is pivotally supported by the frame such that the axial portion extends in a direction perpendicular to a swing plane in which the link member is reciprocatively swung; and an eccentric portion which is eccentric with an axis line of the axial portion and which is engaged with the bifurcate end portion of the link member such that the eccentric portion is fitted in an inner space of the bifurcate end portion; a plate member whose one end portion is fixed to the axial portion of the eccentric member such that the plate member extends in a direction perpendicular to the axis line of the axial portion; and a pair of elastic members which cooperate with each other to sandwich the other end portion of the plate member and which elastically connect the plate member to the frame. When the swinging of the link member is stopped by the actuator, the eccentric portion of the eccentric member is rotated with the axial portion thereof by the bifurcate end portion of the link member. Consequently the plate member is rotated and one of the two elastic members against which the plate member is rotated is elastically deformed or compressed. This elastic compression of the one elastic member effectively prevents the vibration of the link member.

(5) According to a fifth feature of the present invention that includes the first feature (1), the fulcrum portion of the link member comprises a bifurcate end portion, and the supporting device comprises a frame; an axis member which is supported by the frame such that the axis member extends in a direction perpendicular to a swing plane in which the link member is reciprocatively swung; an annular elastic member which is fitted on the axis member; and a sleeve member which is fitted on the annular elastic member and which is fitted in an inner space of the bifurcate end portion of the link member. When the swinging of the link member is stopped by the actuator, the bifurcate end portion of the link member is slightly vibrated. Consequently the annular elastic member is elastically deformed or compressed via the sleeve member. This elastic compression of the annular elastic member effectively prevents the vibration of the link member.

(6) According to a sixth feature of the present invention that includes the first feature (1), the supporting device comprises a frame; a first axis member which extends in a direction perpendicular to a swing plane in which the link member is reciprocatively swung, and which is pivotally connected to the fulcrum portion of the link member; a second axis member which is pivotally supported by the frame such that the second axis member extends parallel to the first axis member; and a connection link which includes an elastic member incorporated in an intermediate portion thereof and which elastically connects the first and second axis members to each other. When the swinging of the link member is stopped by the actuator, the first axis member pivotally connected to the fulcrum portion of the link member is slightly vibrated relative to the second axis member pivotally supported by the frame, via the elastic member of the connection link. Consequently the elastic member of the connection link is elastically deformed. This elastic deformation of the elastic member effectively prevents the vibration of the link member.

(7) According to a seventh feature of the present invention that includes the first feature (1), the supporting device comprises a frame; a first axis member which extends in a direction perpendicular to a swing plane in which the link member is reciprocatively swung, and which is pivotally connected to the fulcrum portion of the link member; a second axis member which is pivotally supported by the frame such that the second axis member extends parallel to the first axis member; a connection link which connects the first and second axis members to each other; and a leaf spring whose one end portion is fixed to the second axis member such that the leaf spring extends in a direction perpendicular to the second axis member, and whose other end portion is engaged with the frame. When the swinging of the link member is stopped by the actuator, the first axis member pivotally connected to the fulcrum portion of the link member is slightly vibrated relative to the second axis member pivotally supported by the frame, via the connection link. Consequently the leaf spring fixed to the connection link is elastically deformed. This elastic deformation of the leaf spring effectively prevents the vibration of the link member.

(8) According to an eighth feature of the present invention, there is provided a sewing machine comprising a needle bar to which a sewing needle is attached; and a needle-bar reciprocating device comprising a link member operatively connected to the needle bar, and a link-member swinging apparatus according to claim 1, and the link-member swinging apparatus laterally reciprocates the needle bar, by reciprocatively swinging the link member operatively connected to the needle bar. When the swinging of the link member is stopped by the actuator, the fulcrum portion of the link member that is elastically supported by the supporting device is permitted to be elastically moved from its reference position. Thus, the portion of the link member to which the needle bar is connected is effectively prevented from being vibrated. Thus, the sewing needle held by the needle holder can be stably stopped at respective stitch positions at opposite ends of a predetermined reciprocal stroke, and additionally the speed of lateral reciprocation of the needle can be increased.

(9) According to a ninth feature of the present invention, there is provided a swing-link apparatus, comprising a frame; a swing link which is engaged via an axis member with the frame such that the swing link is swingable relative to the frame; a drive device which is supported by the frame, which is connected to an input portion of the swing link that is distant from the axis member, and which is repetitively operated forward and backward such that the drive device is kept still for at least one of a first time duration between each of the repetitive forward operations thereof and a following one of the repetitive backward operations thereof and a second time duration between each of the repetitive backward operations thereof and a following one of the repetitive forward operations thereof, so that the repetitive forward and backward operations of the drive device reciprocatively swing the swing link about an axis line of the axis member; and a restoring device which is provided between the frame and a fulcrum portion of the swing link that is engaged with the axis member, which permits the fulcrum portion of the swing link to be moved from a reference position of the fulcrum portion, and which applies a restoring force to the fulcrum portion in a direction in which the fulcrum portion is moved back to the reference position thereof.

(10) According to a tenth feature of the present invention that includes the ninth feature (9), the restoring device has a vibration characteristic which reduces vibration of the swing link that is temporarily produced when the drive device is stopped and kept still for the at least one of the first and second time durations.

(11) According to an eleventh feature of the present invention that includes the ninth or tenth feature (9) or (10), the drive device is kept still for each of the first and second time durations.

(12) According to a twelfth feature of the present invention that includes any one of the ninth to eleventh features (9) to (11), the swing link comprises a drive link which includes an output portion which is distant from the axis member and which is adapted to reciprocate an object.

(13) According to a thirteenth feature of the present invention that includes any one of the ninth to twelfth features (9) to (12), the restoring device comprises a pivotable member which is supported by the frame such that the pivotable member is pivotable about an axis line thereof, the axis member being secured to the pivotable member such that the axis member is eccentric with the axis line of the pivotable member; and a torque applying device which includes an elastic member and which utilizes an elastic force of the elastic member for applying a torque to pivot the pivotable member toward a reference rotation position thereof corresponding to the reference position of the fulcrum portion of the swing link.

(14) According to a fourteenth feature of the present invention that includes the thirteenth feature (13), the elastic member comprises a spring member whose one end portion is fixed to the pivotable member such that the spring member extends radially outwardly from the pivotable member, and whose other end portion is engaged with the frame.

(15) According to a fifteenth feature of the present invention that includes any one of the ninth to fourteenth features (9) to (14), the axis member is fixed to the frame and the restoring device comprises an elastic member which is provided between the axis member and the fulcrum portion of the swing link.

(16) According to a sixteenth feature of the present invention, there is provided a reciprocal apparatus, comprising a frame; a reciprocative member which is supported by the frame such that the reciprocative member is reciprocatively moved relative to the frame; a drive device which is supported by the frame and which is repetitively operated forward and backward such that the drive device is kept still for at least one of a first time duration between each of the repetitive forward operations thereof and a following one of the repetitive backward operations thereof and a second time duration between each of the repetitive backward operations thereof and a following one of the repetitive forward operations thereof; a transmitting device which operatively connects the drive device and the reciprocative member to each other and which transmits a drive force of the drive device to the reciprocative member; and a vibration absorbing device which includes an elastic member which separates the transmitting device into a first portion on a side of the reciprocative member and a second portion on a side of the drive device, the elastic member absorbing vibration of a movable portion of the drive device and vibration of the second portion, so that vibration of the reciprocative member is smaller than the vibration of the movable portion that is temporarily produced when the drive device is stopped and kept still for the at least one of the first and second time durations.

(17) According to a seventeenth feature of the present invention, there is provided a zigzag sewing machine, comprising a machine frame; a needle bar which is supported by the machine frame such that the needle bar is reciprocatively moved in each of an axial direction thereof and a transverse direction thereof substantially perpendicular to the axial direction; an electric motor which is supported by the machine frame and which is repetitively operated forward and backward such that the electric motor is kept still for at least one of a first time duration between each of the repetitive forward operations thereof and a following one of the repetitive backward operations thereof and a second time duration between each of the repetitive backward operations thereof and a following one of the repetitive forward operations thereof; a transmitting device which operatively connects the electric motor and the needle bar to each other and which transmits a drive force of the electric motor to the needle bar so that the needle bar is reciprocatively moved in the transverse direction thereof; and a vibration absorbing device which includes an elastic member which separates the transmitting device into a first portion on a side of the needle bar and a second portion on a side of the electric motor, the elastic member absorbing vibration of the second portion and vibration of a movable portion of the electric motor, such that vibration of the needle bar in the transverse direction thereof is smaller than vibration of the movable portion that is temporarily produced in the transverse direction when the movable portion is stopped and kept still for the at least one of the first and second time durations.

(18) According to an eighteenth feature of the present invention that includes the seventeenth feature (17), the transmitting device comprises a rod which is supported by the machine frame such that the rod extends in a substantially horizontal direction and is movable in an axial direction thereof; a needle-bar support frame which is connected to one of opposite end portions of the rod and which supports the needle bar such that the needle bar is movable in the axial direction thereof; a swing link which is engaged via an axis member with the machine frame such that the swing link is swingable relative to the machine frame and which includes an output portion which is distant from the axis member and which is operatively connected to the other end portion of the rod; and a connecting device which connects an output portion of the movable portion of the electric motor, to an input portion of the swing link that is distant from the axis member, so as to transmit the driving force of the electric motor to the input portion of the swing link, and the vibration absorbing device comprises a restoring device which is provided between the machine frame and a fulcrum portion of the swing link that is engaged with the axis member, which permits the fulcrum portion of the swing link to be moved from a reference position of the fulcrum portion, and which applies a restoring force to the fulcrum portion in a direction in which the fulcrum portion is moved back to the reference position thereof.

(19) According to a nineteenth feature of the present invention that includes the eighteenth feature (18), the restoring device comprises a pivotable member which is supported by the machine frame such that the pivotable member is pivotable about an axis line thereof, the axis member being secured to the pivotable member such that the axis member is eccentric with the axis line of the pivotable member; and a torque applying device which utilizes an elastic force of the elastic member for applying a torque to pivot the pivotable member toward a reference rotation position thereof corresponding to the reference position of the fulcrum portion of the swing link.

(20) According to a twentieth feature of the present invention that includes the seventeenth feature (17), the transmitting device comprises a rod which is supported by the machine frame such that the rod extends in a substantially horizontal direction and is movable in an axial direction thereof; a needle-bar support frame which is connected to one of opposite end portions of the rod and which supports the needle bar such that the needle bar is movable in the axial direction thereof; a swing link which is engaged via an axis member with the machine frame such that the swing link is swingable relative to the machine frame and which includes an output portion which is distant from the axis member and which is operatively connected to the other end portion of the rod; and a connecting device which connects an output portion of the movable portion of the electric motor, to an input portion of the swing link that is distant from the axis member, so as to transmit the driving force of the electric motor to the input portion of the swing link, and the vibration absorbing device comprises a restoring device comprises the elastic member which is provided between the output portion of the swing link and the other end portion of the rod.

(21) According to a twenty-first feature of the present invention that includes any one of the eighteenth to twentieth features (18) to (20), the electric motor comprises, as the movable portion thereof, a rotor which is rotatable about an axis line thereof, and an output shaft which is rotatable with the rotor, and the connecting device comprises a crank arm whose one end portion is fixed to the output shaft as the output portion of the movable portion and whose other end portion is connected to the input portion of the swing link such that the crank arm is pivotable about an axis line parallel to an axis line of the output shaft.

(22) According to a twenty-second feature of the resent invention that includes the twenty-first feature (21), one of the swing link and the machine frame supports the axis member as a first axis member and the other of the swing link and the machine frame includes a first recessed portion which is engaged with the first axis member, one of the other end portion of the crank arm and the input portion of the swing link supports a second axis member parallel to the axis line of the output shaft, and the other of the other end portion of the crank arm and the input portion of the swing link includes a second recessed portion which is engaged with the second axis member, and one of the first and second recessed portions defines a circular hole having a circular cross section and the other of the first and second recessed portions defines an elongate recess which is elongate in a direction substantially parallel to a straight line perpendicular to each of the respective axis lines of the first and second axis members.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
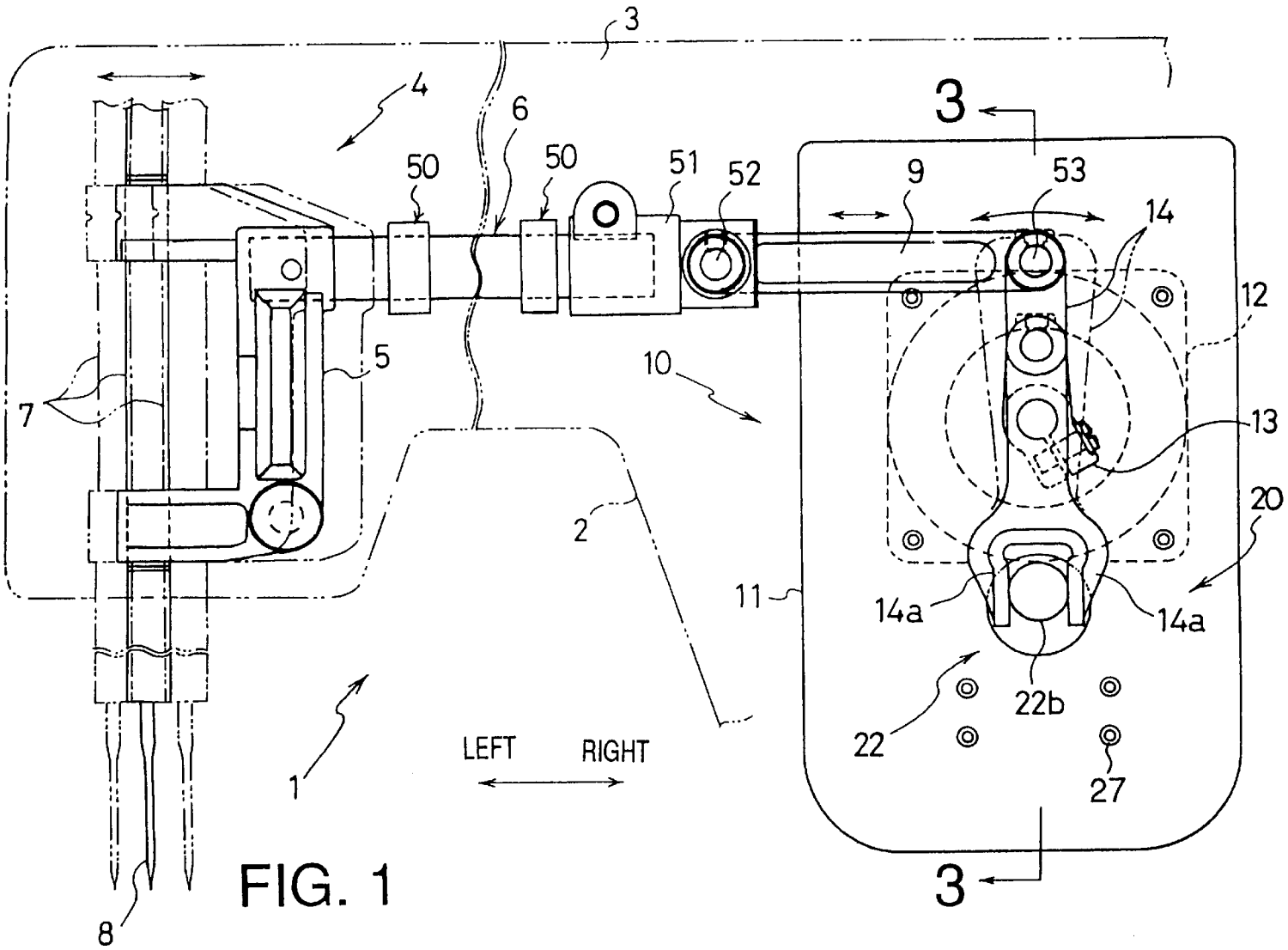
FIG. 1 is a front elevation view of a sewing machine including a link-member swinging apparatus to which the present invention is applied.

Referring to FIGS. 1 to 4 and FIGS. 5A and 5B, there will be described a link-member swinging apparatus 10 for reciprocatively swinging a link member 14 and thereby reciprocating a needle-bar support device 4 employed in an electronic zigzag sewing machine 1. The link-member swinging apparatus 10 and the zigzag sewing machine 1 embody the present invention.

First, the needle-bar support device 4 will be described. However, the support device 4 is well known in the art, it will be described briefly.

The sewing machine 1 includes an arm portion 3 in a free end portion of which a needle-bar support-frame member 5 having a generally U-shaped configuration in its front elevation view is provided. A needle bar 7 which vertically extends is supported by the support-frame member such that the needle bar 7 can be reciprocated up and own. A sewing needle 8 is attached to a lower end of the needle bar 7.

The needle-bar support-frame member 5 is fixed to one of opposite end portions of a shaft 6 which horizontally extends in an intermediate portion of the arm portion 3. The shaft 6 is supported by a framework 2 of the sewing machine 1 via two bearings 50 such that the shaft 6 is horizontally slideable. A connection member 51 which is fixed to the other end portion of the shaft 6, is pivotally connected to one of opposite end portions of a connection lever 9 via a pin 52. The other end portion of the connection lever 9 is pivotally connected via a pin 53 to the link member 14 which is reciprocatively pivoted by the link-member swinging apparatus 10. When the link member 14 is reciprocatively pivoted, the needle-bar support-frame member 5 is simultaneously reciprocated via the link lever 9. Thus, the needle bar 7 is horizontally reciprocated as shown in two-dot chain lines in FIG. 1. While the needle bar 7 is horizontally reciprocated, it is also vertically reciprocated so that the sewing needle 8 cooperates with a thread-loop catcher (not shown) provided in a bed portion of the sewing machine 1, to form zigzag stitches on a work sheet such as a cloth or a leather. The manner in which the needle bar 7 is vertically reciprocated will not be described because it is well known in the art.

Next, there will be described the link-member winging apparatus 10 which is provided in a columnar portion of the sewing machine 1.

A base plate 11 is fixed to the frame 2 of the column portion of the sewing machine 1, and a stepper motor 12 as a drive source is fixed to a rear surface of the base plate 11. An output shaft 12*a* of the drive motor 12 extends through the thickness of the base plate 11, from the rear side of the plate 11 to the front side thereof. A base portion of a drive lever 13 is fixed to the output shaft 12*a*, and an end portion of the drive lever 13 is pivotally connected via a pin 13*a* to a near-end portion of the link member 14 that is near to the upper end of the same 14. The near-end portion of the link member 14 can be the as an intermediate portion of the same 14 as seen in a longitudinal direction thereof. The near-end portion will be referred to as the "input" portion 14*b*. The link member 14 is connected, at the upper end portion thereof, to one end portion of the connection lever 9.

As the drive motor 12 is reciprocatively driven or rotated clockwise and counterclockwise, the upper end portion of the drive lever 13 is reciprocatively pivoted clockwise and counterclockwise, so that the link member 14 is reciprocatively pivoted clockwise and counterclockwise about a lower end portion thereof.

Next, there will be described a link supporting device 20 which supports the lower end portion of the link member 14, i.e., fulcrum portion of the same 14.

The fulcrum portion of the link member 14 includes a bifurcate end portion 14*a*. The base plate 11 has a through-hole 11*a* at a position corresponding to the bifurcate portion 14*a*. A cylindrical sleeve member 21 is fitted in the through-hole 11*a*, and an eccentric axis member 22 is fitted in the sleeve member 21 such that the eccentric axis member 22 is pivotable about an axis line, S, which is perpendicular to a plane in which the link member 14 is swung.

Figure 3:
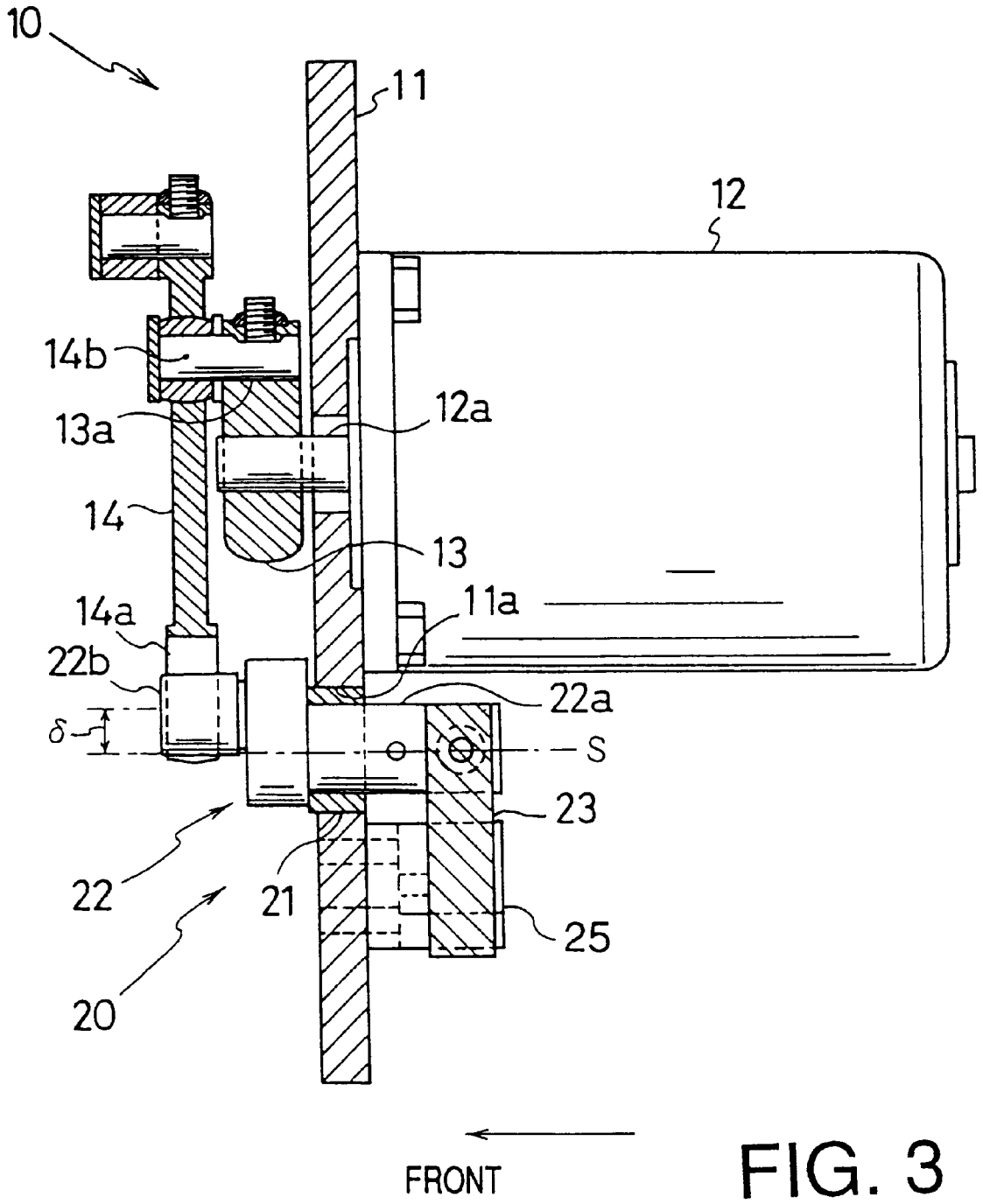
FIG. 3 is a longitudinal cross section of a link supporting device of the link-member swinging apparatus of FIG. 1, taken along Line 3—3 shown in FIG. 1.
Figure 4:
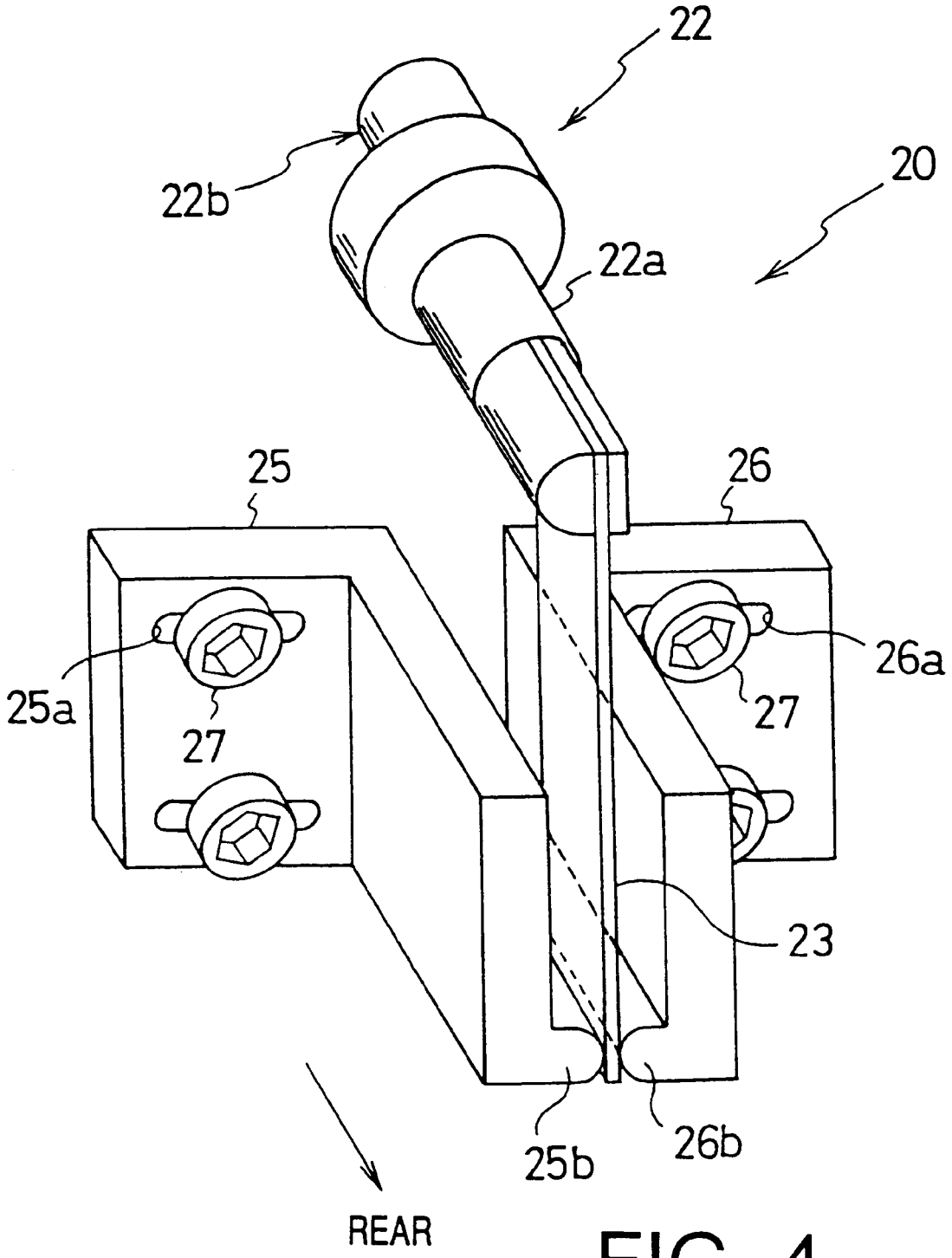
FIG. 4 is a schematic perspective view of the link supporting device of FIG. 3.

As shown in FIGS. 3 and 4, the eccentric axis member 22 includes a pivotable axis portion 22*a* which is supported by the base plate 11 such that the pivotable axis portion 22*a* is pivotable about the axis line S; and an eccentric axis portion 22*b* which is integrally formed with the pivotable axis portion 22*a*.

The eccentric axis portion 22*b* is located on the front side of the base plate 11, and an axis line of the eccentric axis portion 22*b* is deviated from the axis line S of the pivotable axis portion 22*a* by a predetermined distance, δ, in a vertically upward direction. The bifurcate portion 14*a* of the link member 14 is externally engaged with the eccentric axis portion 22*b* of the eccentric axis member 22.

Meanwhile, an upper end portion of a rectangular leaf spring 23 which vertically extends is fixed to a rear end portion of the pivotable axis portion 22*a*.

A pair of adjustable blocks 25, 26 each of which has a generally L-shaped configuration in its plane view are fixed via bolts 27 to the base plate 11 at respective positions below the pivotable axis portion 22*a*. The two adjustable blocks 25, 26 have respective pairs of elongate holes 25*a*, 26*a* which are horizontally elongate and through which the bolts 27 are fastened to the base plate 11. Thus, the position of each of the blocks 25, 26 is adjustable in a horizontal direction. The two blocks 25, 26 have respective elongate projections 25*b*, 26*b* which project toward each other from respective lower end portions of the blocks 25, 26 and which cooperate with each other to pinch, with a certain pressure, a lower end portion of the leaf spring 23. The two projections 25*b*, 26*b* have respective substantially half-cylindrical engaging surfaces which engage opposite elongate surfaces of the lower end portion of the leaf spring 23, respectively. Thus, the two projections 25*b*, 26*b* contact the leaf spring 23 via respective peak "lines" (not "points") of the half-cylindrical engaging surfaces thereof. The leaf spring 23 has a predetermined thickness, and has an elastic characteristic that is so predetermined as to reduce vibration of the link member 14, as described later.

Figure 2:
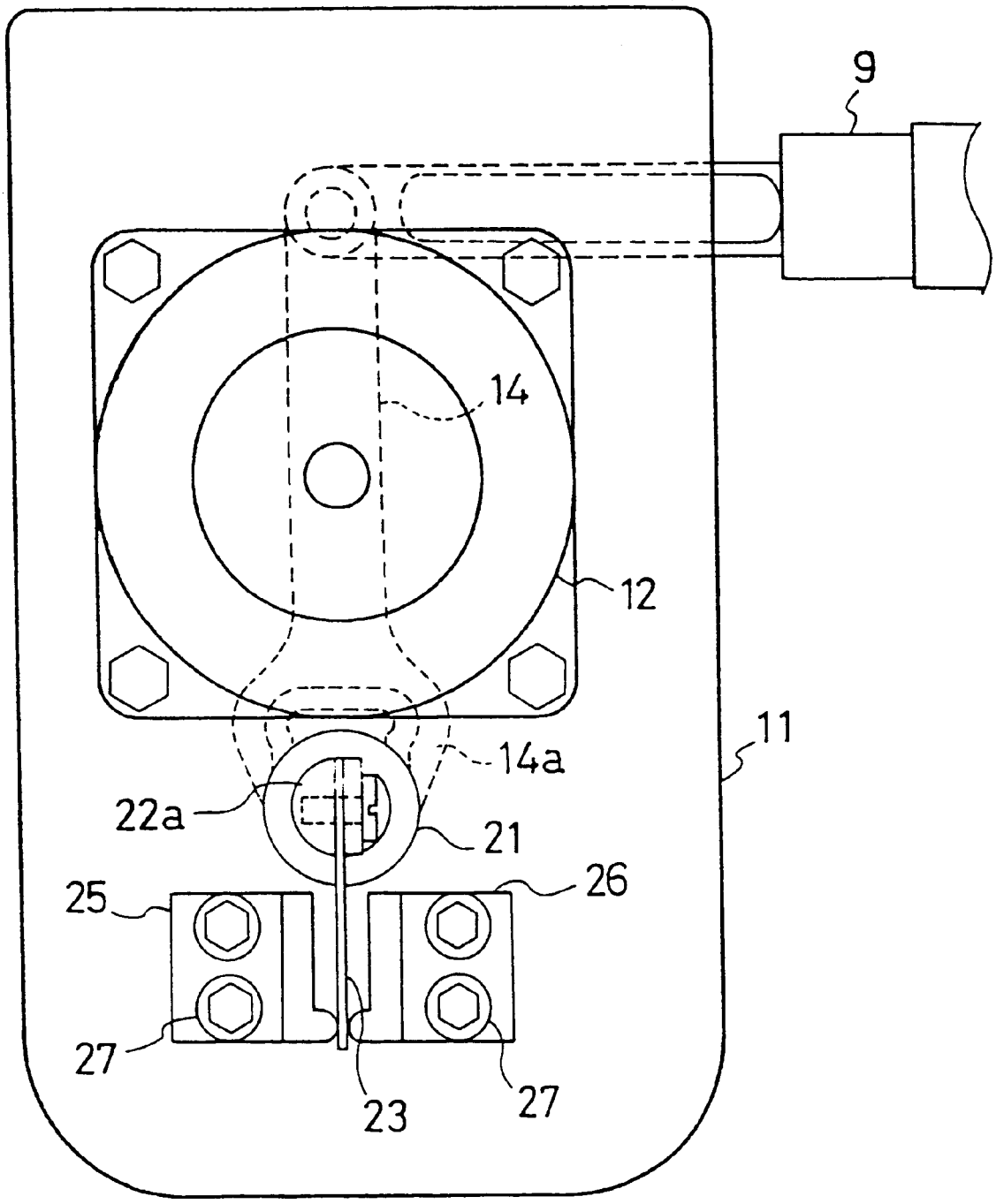
FIG. 2 is a rear elevation view of the link-pivoting apparatus of FIG. 1.

In a normal condition in which no external force is applied to the leaf spring 23, the spring 23 straightly and vertically extends without any strain, as shown in FIG. 4. Therefore, the eccentric axis member 22 takes a normal attitude, as shown in FIGS. 2 and 4, in which the center line of the eccentric axis portion 22*b* is positioned right above the center line S of the pivotable axis portion 22*a*. Thus, the bifurcate end portion 14*a* of the link member 14 that is externally engaged with the eccentric axis portion 22*b* is positioned at a predetermined reference position corresponding to the center line of the eccentric axis portion 22*b* in a substantially horizontal direction. Therefore, when the drive motor 12 is reciprocatively swung, the link member 14 is reciprocatively pivoted about the center line of the eccentric axis portion 22*b* via the bifurcate portion 14*a* thereof.

Next, there will be described the operation and advantages of the link-member swinging apparatus 10 constructed as described above.

Figure 5A:
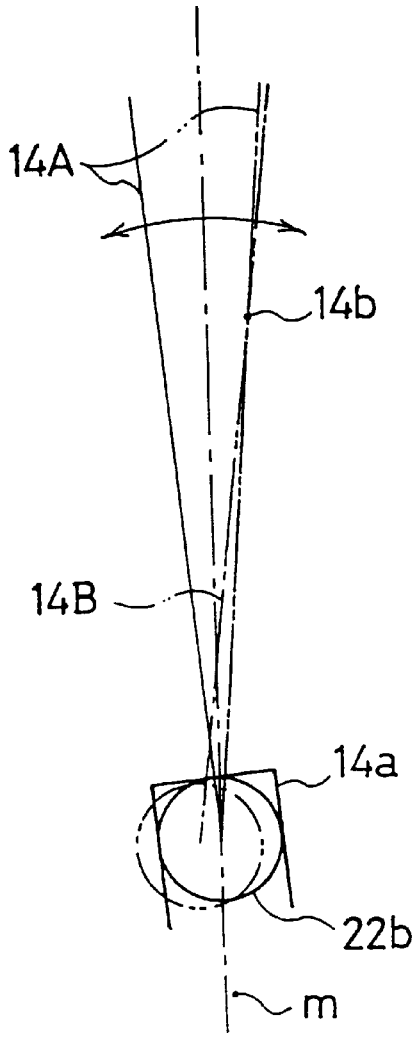
FIG. 5A is a view for explaining vibration of a link member when a drive motor of the link-member swinging apparatus of FIG. 1 is stopped.

When the electronic sewing machine 1 carries out the zigzag sewing operation, the drive motor 12 is reciprocatively rotated by an angle corresponding to the width of the zigzag pattern to be formed, i.e., the distance by which the needle bar 7 is reciprocatively moved laterally. Therefore, the drive lever 13 is reciprocatively pivoted and, as shown in FIG. 5A, the link member 14A indicated in solid line is reciprocatively swung about the eccentric axis portion 22*b*, symmetrically with respect to a vertical center line, m. Accordingly, the needle-bar support-frame member 5 is horizontally reciprocated via the connection lever 9 and the shaft 6, so that the needle bar 7 is reciprocated and the zigzag stitches are formed on the work sheet. Since the length of the drive lever 13 is smaller than that of the link member 14, the position of the link member 14 is slightly moved in a vertical direction, when the link member 14 is swung by the drive lever 13. This slight vertical movement of the link member 14 is allowed by sliding of the link member 14 on inner flat surfaces of the bifurcate end portion 14*a* within an inner space of the same 14*a*.

When the rotation of the drive motor 12 is stopped to allow the sewing needle 8 to penetrate the work sheet and form a stitch thereon, the swinging of the link member 14 is also stopped via the drive lever 13.

However, in the case where the needle-bar support device 4 and the link member 14 itself have a great mass, i.e., a great inertia, the link member 14 receives a shock due to the inertia, when it is stopped. Accordingly, the link member 14 is vibrated, i.e., slightly swung about the bifurcate end portion 14*a* thereof, i.e., the fulcrum portion thereof.

The bifurcate end portion 14*a* of the link member 14 is engaged with the eccentric axis portion 22*b*, and an angular position of the pivotal axis portion 22*a* or the eccentric axis portion 22*b* is defined by the leaf spring 23 only, as described above. Therefore, as shown in FIG. 5A, the link member 14B indicated in two-dot chain line is vibrated, i.e., swung about the input portion 14*b* thereof in the same plane as the plane in which the link member 14A indicated in solid line is swung about the bifurcate end portion 14*a*. FIG. 5A exaggerates the vibration of the link member 14B, for illustration purposes only, though, in fact, the vibration is very small.

Figure 5B:
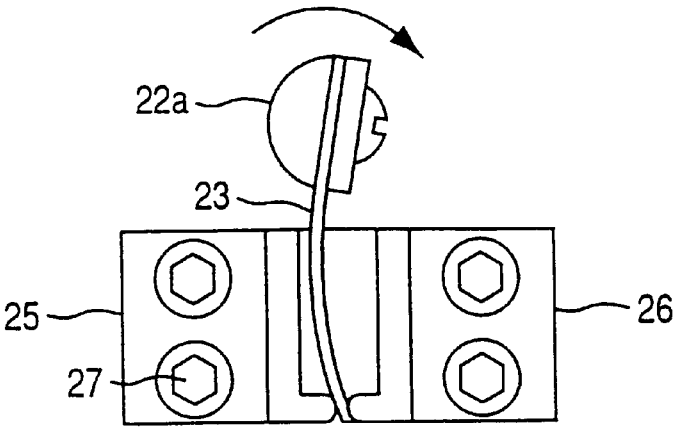
FIG. 5B is a rear elevation view of a portion of the link supporting device of FIG. 3, for explaining elastic deformation of a leaf spring of the link supporting device.

Thus, the bifurcate end portion 14*a* is vibrated, and the eccentric axis portion 22*b* alternatively receives a leftward force and a rightward force each for a very short time duration. For example, when the eccentric axis portion 22*b* receives a leftward force, the eccentric axis member 22 is pivoted counterclockwise as seen in FIG. 1, and accordingly the pivotable axis portion 22*a* is pivoted clockwise as seen in FIG. 5B, so that the leaf spring 23 is elastically deformed. Since the leaf spring 23 is held by the respectively peak lines of the elongate projections 25*b*, 26*b* of the adjustable blocks 25, 26, the entire leaf spring 23 can function, when being elastically deformed, to absorb effectively the vibration of the link member 14. The blocks 25, 26 may have, in place of the respective half-cylindrical projections 25*b*, 26*b*, respective wedge-like projections at which the blocks 25, 26 hold the leaf spring 23.

On the other hand, when the eccentric axis portion 22*b* receives a rightward force because of the vibration of the bifurcate portion 14*a*, the eccentric axis member 22 is pivoted clockwise as seen in FIG. 1, and accordingly the pivotable axis portion 22*a* is pivoted counterclockwise as seen in FIG. 5B, so that the leaf spring 23 is elastically deformed. Thus, the vibration of the link member 14 can be quickly and effectively attenuated by the elastic deformation of the leaf spring 23. The link supporting device 20 enjoys a simple construction.

Since the vibration of the lower end portion (i.e., the bifurcate end portion 14*a*) of the link member 14 is minimized when the swinging of the link member 14 is stopped, the vibration of the connection lever 9, the shaft 6, and the needle-bar support-frame member 5 that are connected to the upper end portion of the link member 14 is also minimized when the horizontal motion of those members 9, 6, 5 is stopped.

Therefore, in the state in which the sewing needle 8 is sticking the work sheet, the needle 8 is prevented from being horizontally vibrated. Thus, the sewing needle 8 can form neat zigzag stitches. In addition, since the vibration of the sewing needle 8 is minimized, the needle 8 can be reciprocated at a high speed. Accordingly, the speed of sewing of the sewing machine 1 can be increased. Moreover, no additional load such as a friction resistance is applied to the link member 14 while the link member 14 is reciprocatively swung by the drive motor 12. Thus, the drive motor 12 enjoys a small size or capacity. The drive motor 12 that is provided by a stepper motor, is prevented from losing synchronism when the rotation thereof is resumed.

Figure 6:
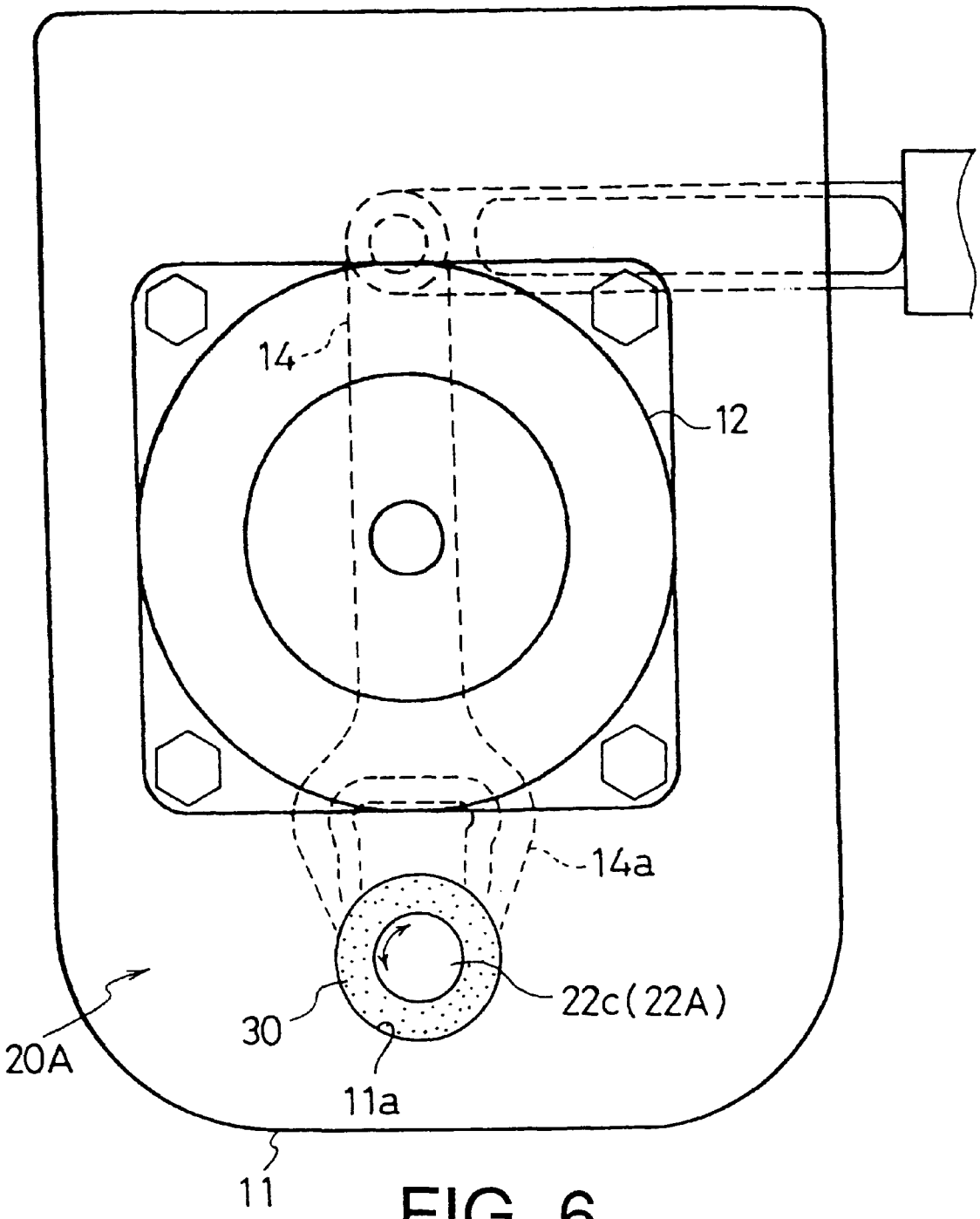
FIG. 6 is a rear elevation view of a link supporting device of another link-member swinging apparatus as a second embodiment of the present invention.

FIG. 6 shows a second embodiment of the present invention, in which the link supporting device 20 shown in FIG. 1 is partly modified to a link supporting device 20A.

A bifurcate end portion 14*a* provided by a lower end portion of a link member 14 is externally engaged with an eccentric axis portion 22*b* of an eccentric axis member 22A, and a pivotable axis portion 22*c* of the eccentric axis member 22A is pivotally supported by a base plate 11 via an annular elastic member 30 formed of a hard rubber. The annular elastic member 30 is fixed to an outer surface of the pivotable axis portion 22*c* by adhesion with an adhesive, and is fixed to a through-hole 11*a* formed through a thickness of the base plate 11, by adhesion with an adhesive.

When rotation of a drive motor 12 is stopped, the link member 14 vibrates, and the bifurcate end portion 14*a* thereof rotates the eccentric axis portion 22*b* of the eccentric axis member 22A. Therefore, the pivotable axis portion 22*c* is rotated. Consequently the annular elastic member 30 is elastically deformed in a circumferential direction thereof. Thus, the vibration of the link member 14 is effectively attenuated by the elastic deformation of the annular member 30. The link supporting device 20A enjoys a simple construction.

Figure 7:
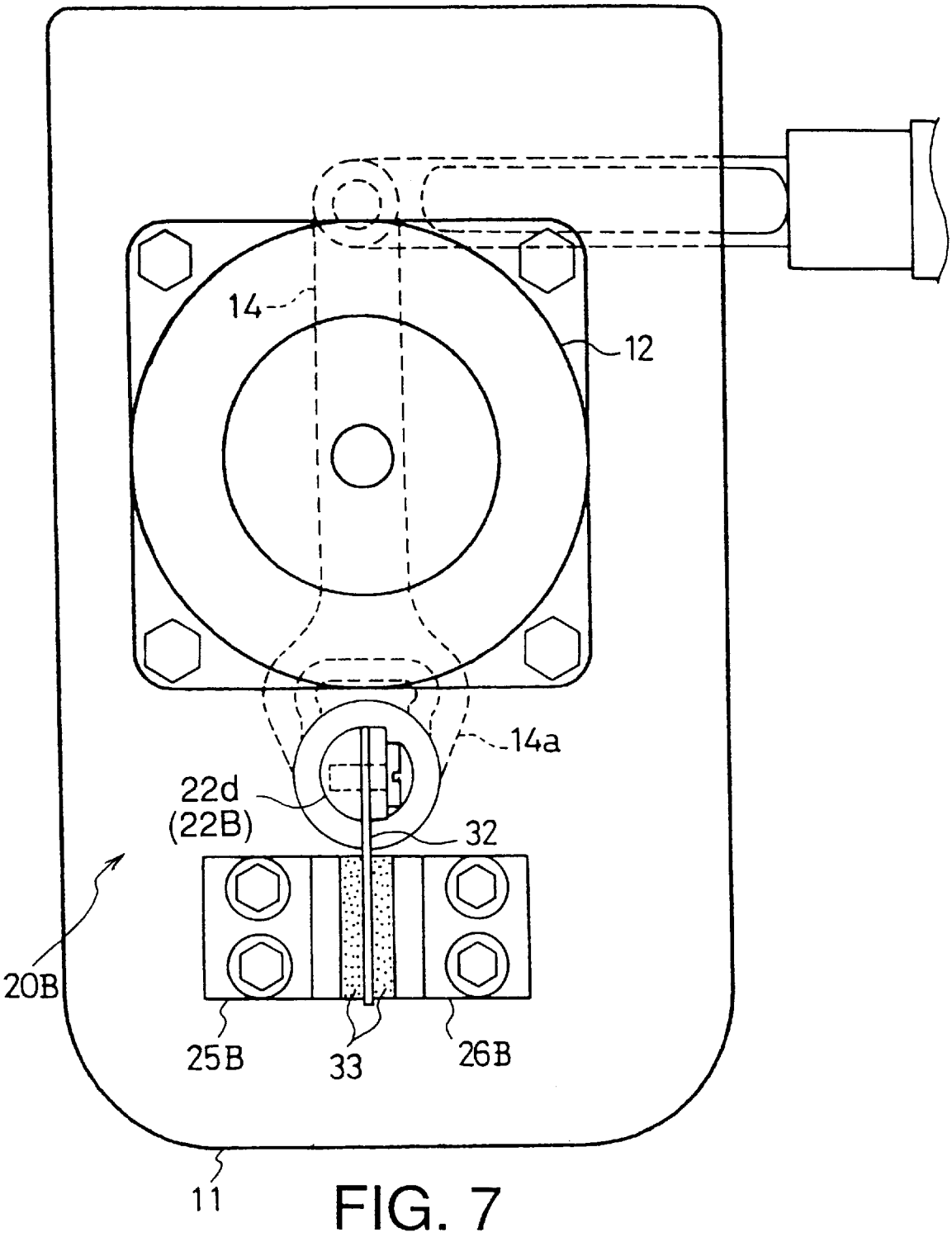
FIG. 7 is a rear elevation view of a link supporting device of another link-member swinging apparatus as a third embodiment of the present invention.

FIG. 7 shows a third embodiment of the present invention, in which the link supporting device 20 shown in FIG. 1 is partly modified to a link supporting device 20B.

A bifurcate end portion 14*a* provided by a lower end portion of a link member 14 is externally engaged with an eccentric axis portion 22*b* of an eccentric axis member 22B, and a pivotable axis portion 22*d* of the eccentric axis member 22B is pivotally supported by a base plate 11. An upper end portion of a plate member 32 formed of a hard material such as a metal or a resin is fixed to the pivotable axis portion 22*d*. A lower end portion of the plate member 32 is elastically pinched and supported by a pair of elastic members 33 each of which is formed of a hard rubber and which are adhered to respective inner surfaces of a pair of blocks 25B, 26B each of which has a generally L-shaped configuration in its plan view and is fixed to a back surface of the base plate 11 via bolts.

When rotation of a drive motor 12 is stopped, the link member 14 vibrates, and the bifurcate end portion 14*a* thereof rotates the eccentric axis portion 22*b* of the eccentric axis member 22B. Therefore, the pivotable axis portion 22*d* is rotated. Consequently the plate member 32 is moved, and one of the two elastic members 33 is elastically deformed by being compressed by the plate member 32 being moved. Thus, the vibration of the link member 14 is effectively attenuated by the elastic deformation of the one elastic member 33. The link supporting device 20B enjoys a simple construction.

Figure 8:
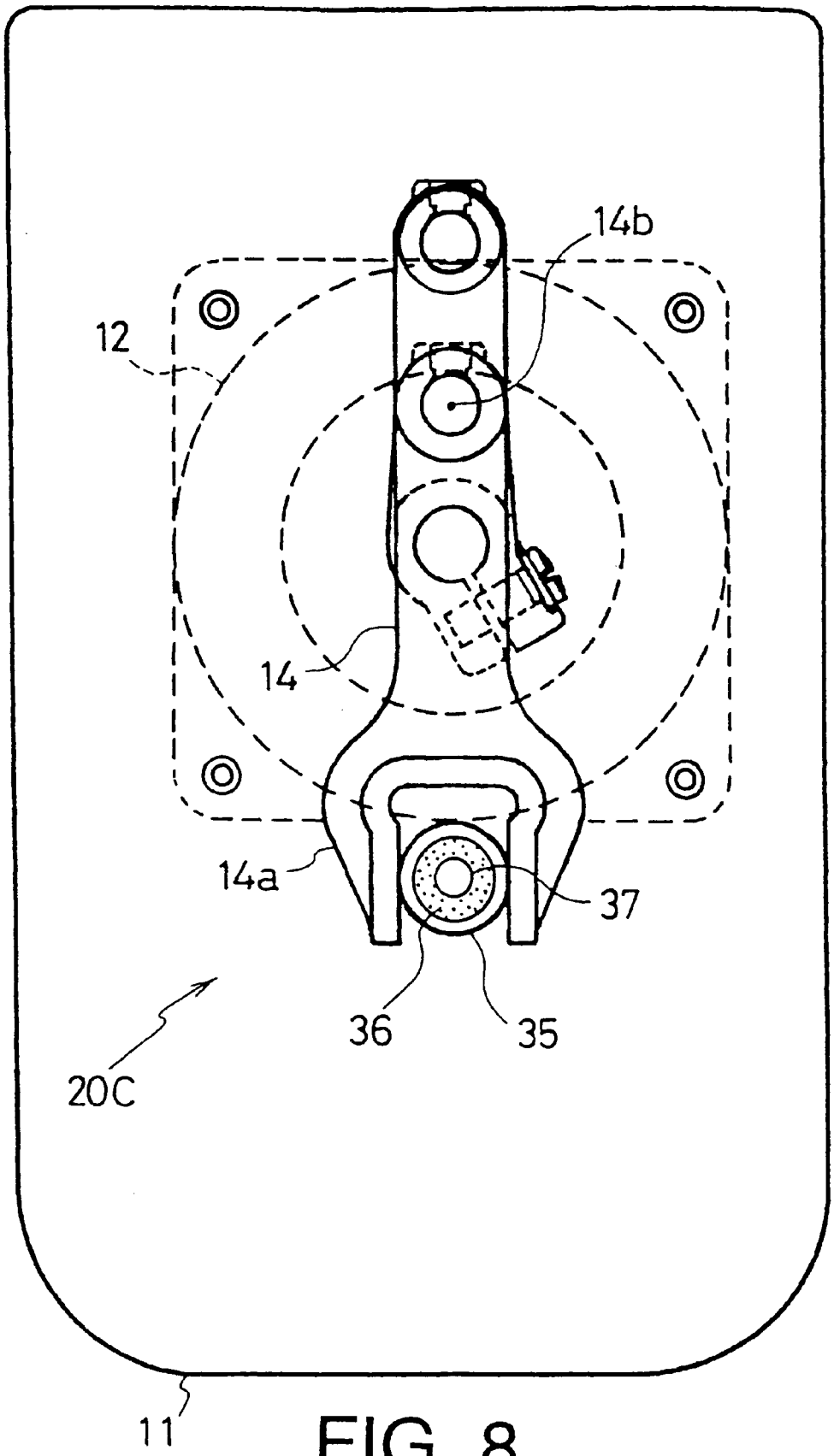
FIG. 8 is a front elevation view of a link supporting device of another link-member swinging apparatus as a fourth embodiment of the present invention.

FIG. 8 shows a fourth embodiment of the present invention, in which the link supporting device 20 shown in FIG. 1 is partly modified to a link supporting device 20C.

A bifurcate end portion 14*a* provided by a lower end portion of a link member 14 is externally engaged with a cylindrical sleeve member 35 formed of a metal. An annular elastic member 36 formed of a hard rubber is fitted in an inner cylindrical space of the sleeve member 35, and is fitted on an axis member 37 which is fixed to a base plate 11 such that the axis member 37 extends horizontally frontward.

When rotation of a drive motor 12 is stopped, the link member 14 vibrates, and the bifurcate end portion 14*a* thereof also vibrates. Consequently the sleeve member 35 is moved relative to the axis member 37, and a portion of the annular elastic member 36 is elastically deformed by being compressed. Thus, the vibration of the link member 14 is effectively attenuated by the elastic deformation of the annular member 36. The link supporting device 20C enjoys a simple construction.

Figure 9:
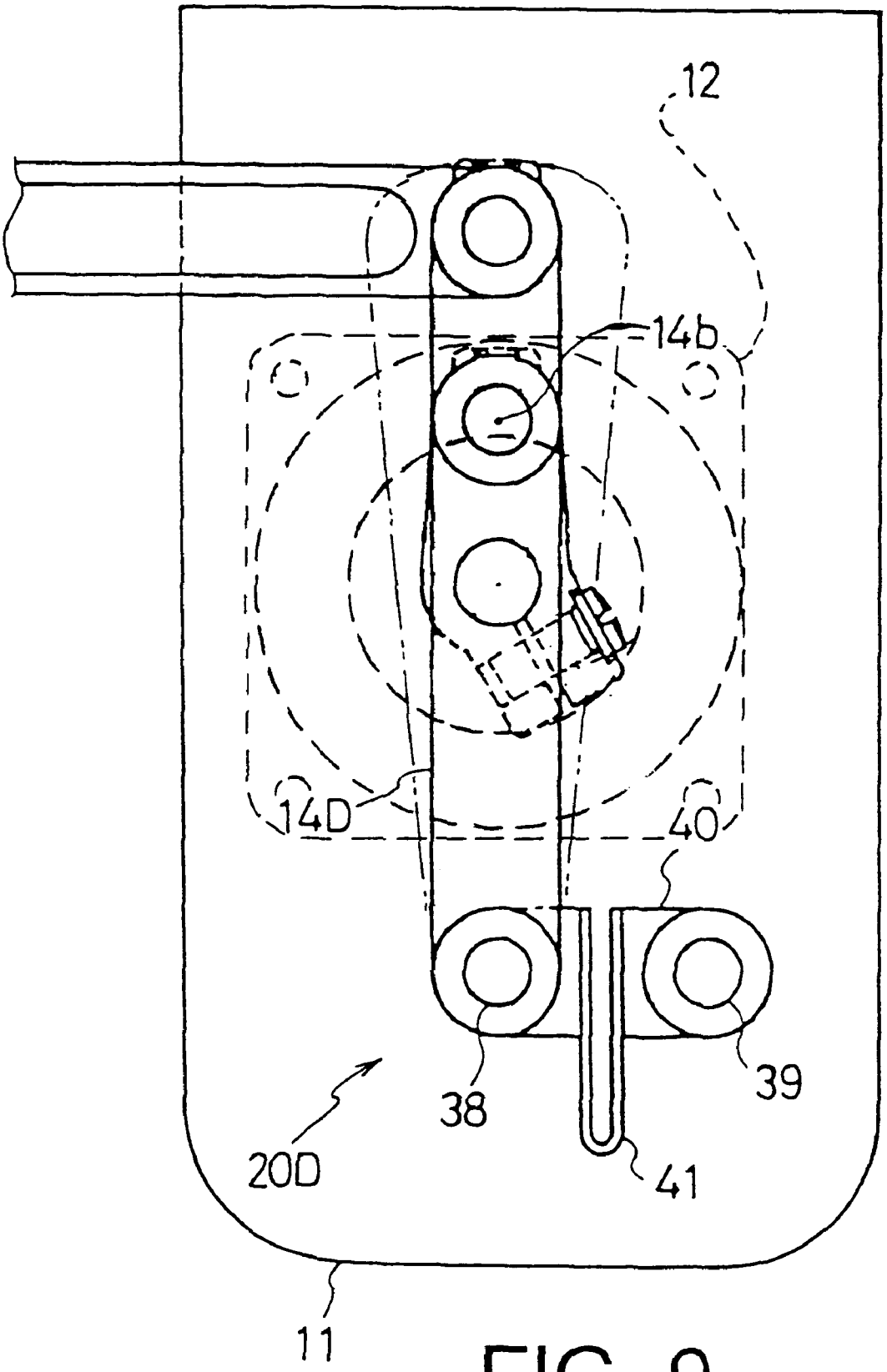
FIG. 9 is a front elevation view of a link supporting device of another link-member swinging apparatus as a fifth embodiment of the present invention.

FIG. 9 shows a fifth embodiment of the present invention, in which the link supporting device 20 shown in FIG. 1 is partly modified to a link supporting device 20D.

A lower end of a link member 14D is pivotally connected to a link-support axis member 38 which extends in a direction perpendicular to a base plate 11. A base axis member 39 is pivotally supported by the base plate 11 such that the base axis member 39 extends horizontally frontward parallel to the link-support axis member 38. A connection link 40 which includes, in an intermediate portion thereof, a U-shaped leaf spring 41 as an elastic member elastically connects between the two axis members 38, 39.

When rotation of a drive motor 12 is stopped, the link member 14D vibrates, and the link-support axis member 38 pivotally connected to the link member 14D also vibrates with elastic deformation of the leaf spring 41 of the connection link 40 elastically connected to the base axis member 39. Thus, the vibration of the link member 14D is effectively attenuated by the elastic deformation of the leaf spring 41. The link supporting device 20D enjoys a simple construction. The connection link 40 may include, in an intermediate portion thereof, an elastic member different from the leaf spring 41, such as a plate-like rubber member.

Figure 10:
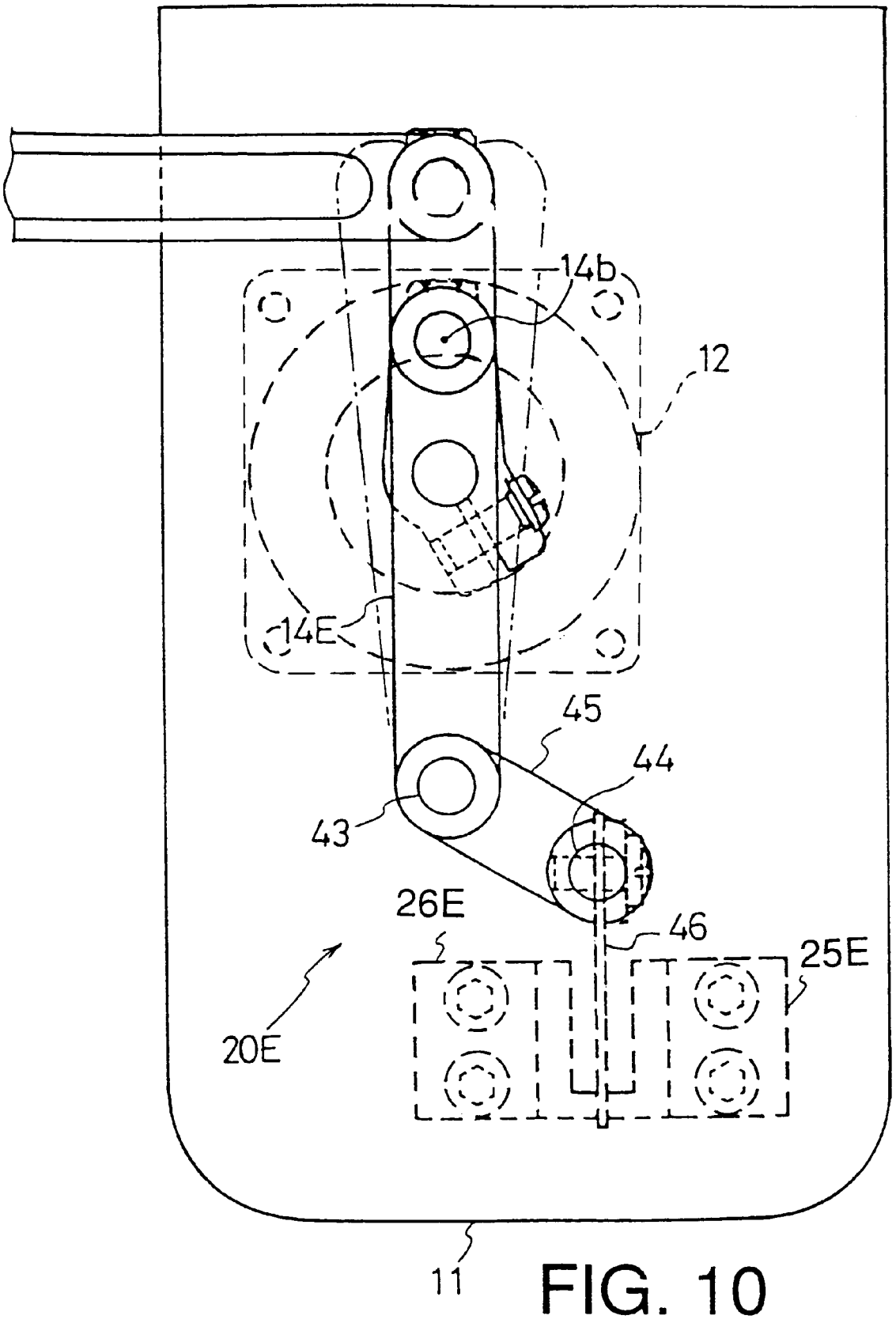
FIG. 10 is a front elevation view of a link supporting device of another link-member swinging apparatus as a sixth embodiment of the present invention.

FIG. 10 shows a sixth embodiment of the present invention, in which the link supporting device 20 shown in FIG. 1 is partly modified to a link supporting device 20E.

A lower end of a link member 14E is pivotally connected to a link-support axis member 43 which extends in a direction perpendicular to a base plate 11. A base axis member 44 is pivotally supported by the base plate 11 such that the base axis member 44 extends horizontally through a thickness of the base plate 11, parallel to the link-support axis member 43. A connection link 45 connects between the two axis members 43, 44. An upper end of a leaf spring 46 which vertically extends is fixed to a rear end portion of the base axis member 44, and a lower end portion of the leaf spring 46 is pinched by a pair of blocks 25E, 26E each of which has a generally L-shaped configuration in its plan view and is fixed to a back surface of the base plate 11 via bolts.

When rotation of a drive motor 12 is stopped, the link member 14E vibrates, and the link-support axis member 43 pivotally connected to the link member 14E also vibrates with the connection link 45 connected to the base axis member 44. Thus, the vibration of the link member 14E is effectively attenuated by the elastic deformation of the leaf spring 46. The link supporting device 20E enjoys a simple construction.

Figure 11:
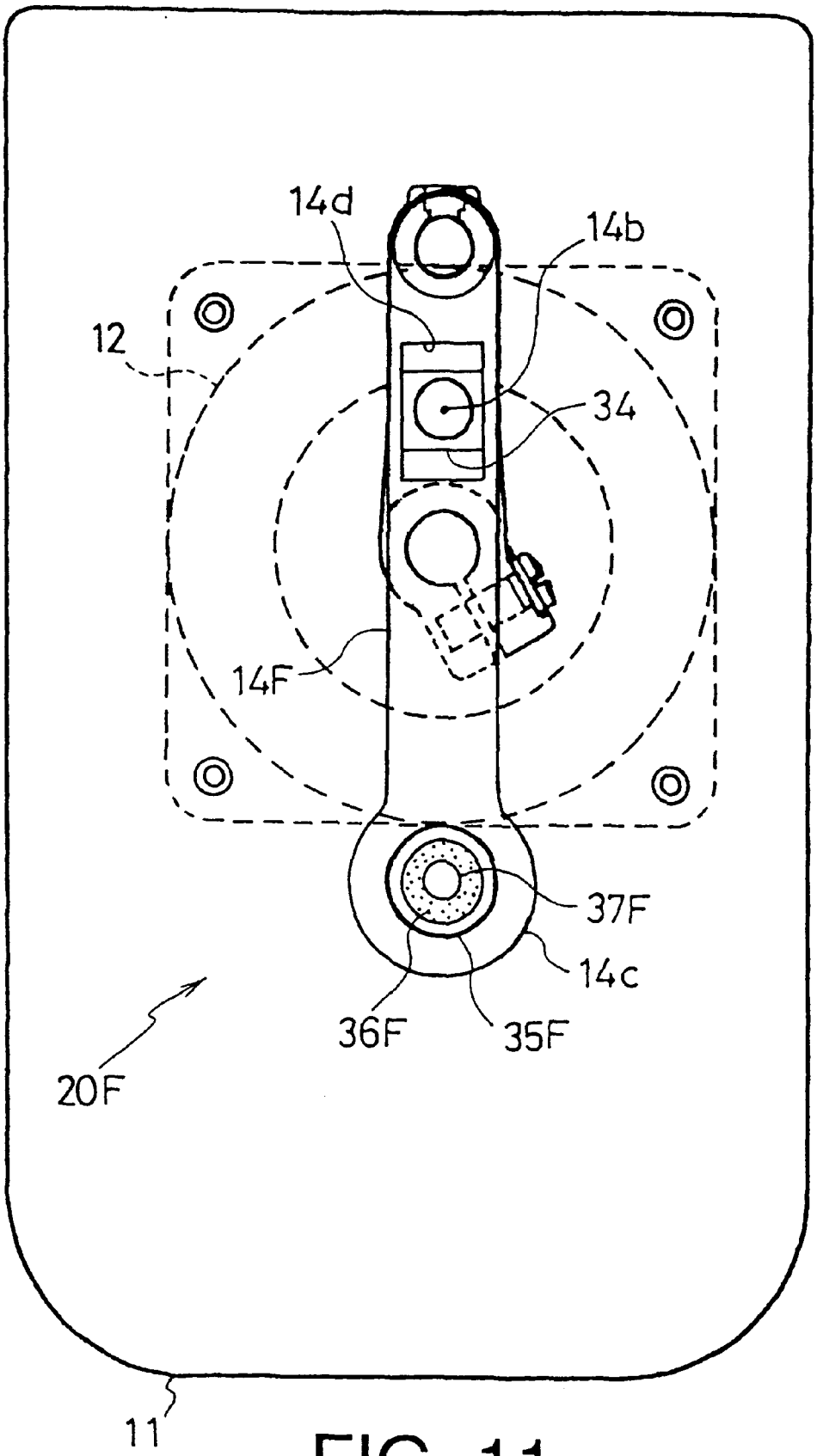
FIG. 11 is a front elevation view of a link supporting device of another link-member swinging apparatus as a seventh embodiment of the present invention.
Figure 12:
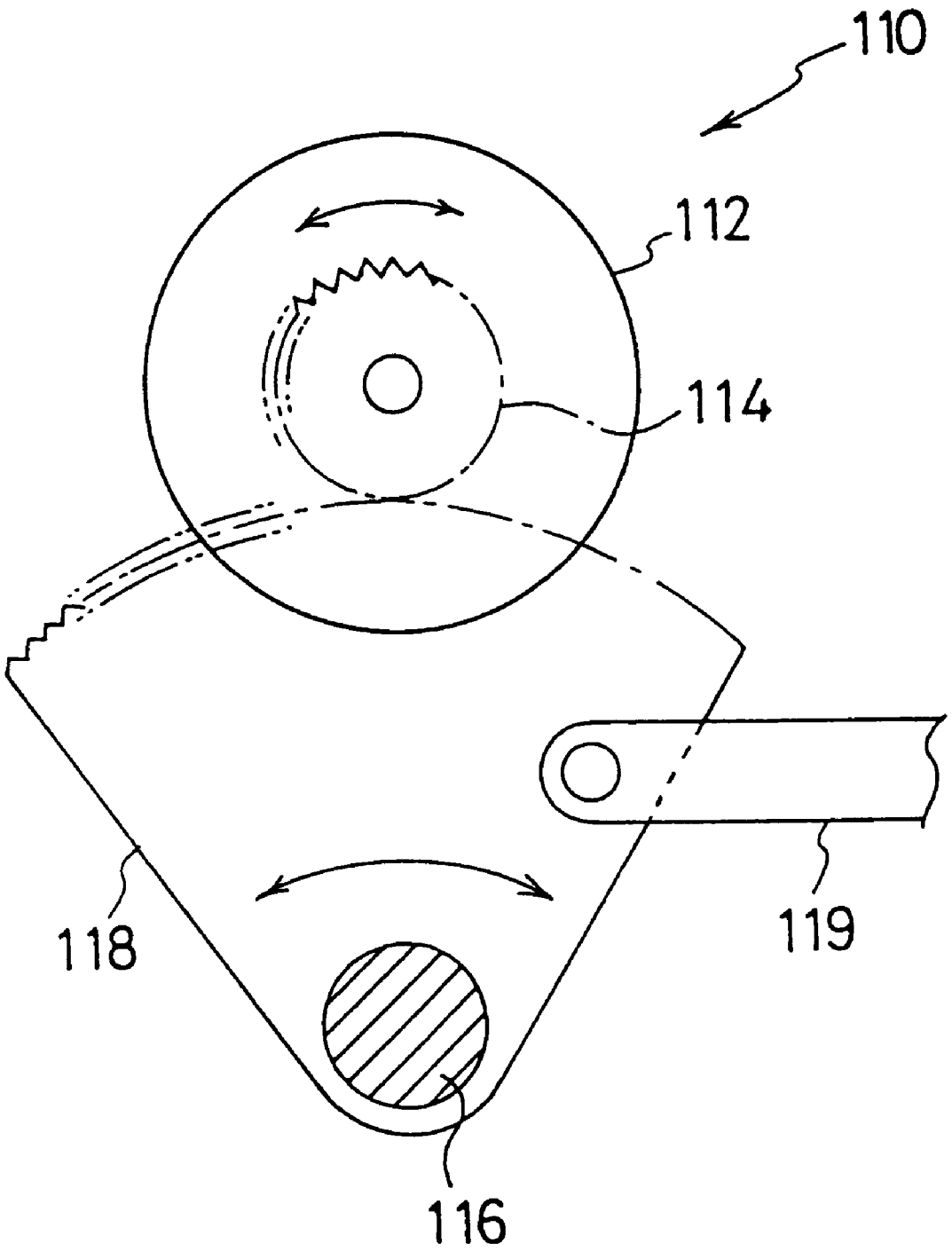
FIG. 12 PRIOR ART
FIG. 12 is a front elevation view of a conventional link-member swinging apparatus.

FIG. 11 shows a seventh embodiment of the present invention, in which the fourth link supporting device 20C shown in FIG. 8 is partly modified to a link supporting device 20F.

An annular portion 14c provided by a lower end portion of a link member 14F is externally engaged with a cylindrical sleeve member 35F formed of a metal. An annular elastic member 36F formed of a hard rubber is fitted in an inner cylindrical space of the sleeve member 35F, and is fitted on an axis member 37F which is fixed to a base plate 11 such that the axis member 37F extends horizontally frontward. The link member 14F has a rectangular hole 14d which is formed through a thickness of a portion thereof near an upper end portion thereof. A square movable member 34 which is fixed to an upper end portion of a drive lever 13 fixed to an output shaft 12*a* of a stepper motor 12, is slideably fitted in the rectangular hole 14d.

When rotation of the stepper motor 12 is stopped, the link member 14F vibrates, and the annular portion 14*c* thereof also vibrates. Consequently the sleeve member 35F is moved relative to the axis member 37F, and a portion of the annular elastic member 36F is elastically deformed by being compressed. Thus, the vibration of the link member 14F is effectively attenuated by the elastic deformation of the annular member 36F. The link supporting device 20F enjoys a simple construction.

In the embodiment shown in FIG. 11, an upper end portion of the link member 14F may be connected to the connection lever 9 via the connection link 40 employed in the embodiment shown in FIG. 9. The connection link 40 includes the U-shaped leaf spring 41. In this case, the annular elastic member 36F may be omitted.

The link member 14, 14D, 14E, 14F which is swung by the link-member swinging apparatus 10 may be used to reciprocate horizontally a feed plate or member (not shown) which is employed in a work-sheet feeding device (not shown) of the electronic sewing machine 1. The principle of the present invention may be applied to a looper drive device which drives a looper for catching the needle thread conveyed by the sewing needle 8; or various sorts of link-member swinging apparatuses which swing respective link members employed in various sorts of mechanical drive systems other than those of sewing machines.

It is to be understood that the present invention may be embodied with various changes, improvements, and modifications that may occur to those skilled in the art without departing from the scope and spirit of the invention defined in the appended claims.

What is claimed is:

1. A link-member swinging apparatus for reciprocatively swinging a link member while keeping a fulcrum portion of the link member at substantially a predetermined location, comprising:

an actuator which is operatively connected to an input portion of the link member, the input portion of the link member being distant from said fulcrum portion thereof in a lengthwise direction of the link member; and a supporting device which elastically supports said fulcrum portion of the link member, while permitting said fulcrum portion to be elastically moved from a reference position thereof in a direction intersecting the lengthwise direction of the link member.

2. An apparatus according to claim 1, wherein said fulcrum portion of the link member comprises a bifurcate end portion, and wherein the supporting device comprises:

a frame;

an eccentric member which includes an axial portion which is pivotally supported by the frame such that the axial portion extends in a direction perpendicular to a swing plane in which the link member is reciprocatively swung; and an eccentric portion which is eccentric with an axis line of the axial portion and which is engaged with the bifurcate end portion of the link member such that the eccentric portion is fitted in an inner space of the bifurcate end portion; and a leaf spring whose one end portion is fixed to the axial portion of the eccentric member such that the leaf spring extends in a direction perpendicular to the axis line of the axial portion, and whose other end portion is engaged with the frame.

3. An apparatus according to claim 1, wherein said fulcrum portion of the link member comprises a bifurcate end portion, and wherein the supporting device comprises:

a frame having a hole;

an eccentric member which includes an axial portion which is pivotally supported by the frame such that the axial portion extends in a direction perpendicular to a swing plane in which the link member is reciprocatively swung; and an eccentric portion which is eccentric with an axis line of the axial portion and which is engaged with the bifurcate end portion of the link member such that the eccentric portion is fitted in an inner space of the bifurcate end portion; and an annular elastic member which is fixed to an outer circumferential surface of the axial portion of the eccentric member and which is fixed to an inner circumferential surface of the hole of the frame.

4. An apparatus according to claim 1, wherein said fulcrum portion of the link member comprises a bifurcate end portion, and wherein the supporting device comprises:

a frame having a hole;

an eccentric member which includes an axial portion which is pivotally supported by the frame such that the axial portion extends in a direction perpendicular to a swing plane in which the link member is reciprocatively swung; and an eccentric portion which is eccentric with an axis line of the axial portion and which is engaged with the bifurcate end portion of the link member such that the eccentric portion is fitted in an inner space of the bifurcate end portion;

a plate member whose one end portion is fixed to the axial portion of the eccentric member such that the plate member extends in a direction perpendicular to the axis line of the axial portion; and a pair of elastic members which cooperate with each other to sandwich the other end portion of the plate member and which elastically connect the plate member to the frame.

5. An apparatus according to claim 1, wherein said fulcrum portion of the link member comprises a bifurcate end portion, and wherein the supporting device comprises:

a frame;

an axis member which is supported by the frame such that the axis member extends in a direction perpendicular to a swing plane in which the link member is reciprocatively swung;

an annular elastic member which is fitted on the axis member; and a sleeve member which is fitted on the annular elastic member and which is fitted in an inner space of the bifurcate end portion of the link member.

6. An apparatus according to claim 1, wherein the supporting device comprises:

a frame;

a first axis member which extends in a direction perpendicular to a swing plane in which the link member is reciprocatively swung, and which is pivotally connected to said fulcrum portion of the link member;

a second axis member which is pivotally supported by the frame such that the second axis member extends parallel to the first axis member; and a connection link which includes an elastic member incorporated in an intermediate portion thereof and which elastically connects the first and second axis members to each other.

7. An apparatus according to claim 1, wherein the supporting device comprises:

a frame;

a first axis member which extends in a direction perpendicular to a swing plane in which the link member is reciprocatively swung, and which is pivotally connected to said fulcrum portion of the link member;

a second axis member which is pivotally supported by the frame such that the second axis member extends parallel to the first axis member;

a connection link which connects the first and second axis members to each other; and a leaf spring whose one end portion is fixed to the second axis member such that the leaf spring extends in a direction perpendicular to the second axis member, and whose other end portion is engaged with the frame.

8. A sewing machine, comprising:

a needle bar to which a sewing machine is attached; and a needle-bar reciprocating device comprising:

a link member operatively connected to the needle bar, and a link member swinging apparatus for reciprocatively swinging the link member while keeping a fulcrum portion of the link member at substantially a predetermined location, the link-member swinging apparatus comprising:

an actuator which is operatively connected to an input portion of the link member, the input portion of the link member being distant from said fulcrum portion thereof in a lengthwise direction of the link member, and a supporting device which elastically supports said fulcrum portion of the link member, while permitting said fulcrum portion to be elastically moved from a reference position thereof in a direction intersecting the lengthwise direction of the link member, wherein the link-member swinging apparatus laterally reciprocates the needle bar, by reciprocatively swinging the link member operatively connected to the needle bar.

9. A swing-link apparatus, comprising:

a frame;

a swing link which is engaged via an axis member with the frame such that the swing link is swingable relative to the frame;

a drive device which is supported by the frame, which is connected to an input portion of the swing link that is distant from the axis member, and which is repetitively operated forward and backward such that the drive device is kept still for at least one of a first time duration-between each of the repetitive forward operations thereof and a following one of the repetitive backward operations thereof and a second time duration between each of the repetitive backward operations thereof and a following one of the repetitive forward operations thereof, so that the repetitive forward and backward operations of the drive device reciprocatively swing the swing link about an axis line of the axis member; and a restoring device which is provided between the frame and a fulcrum portion of the swing link that is engaged with the axis member, which permits the fulcrum portion of the swing link to be moved from a reference position of the fulcrum portion, and which applies a restoring force to the fulcrum portion in a direction in which the fulcrum portion is moved back to the reference position thereof.

10. An apparatus according to claim 9, wherein the restoring device has a vibration characteristic which reduces vibration of the swing link that is temporarily produced when the drive device is stopped and kept still for said at least one of the first and second time durations.

11. An apparatus according to claim 9, wherein the drive device is kept still for each of the first and second time durations.

12. An apparatus according to claim 9, wherein the swing link comprises a drive link which includes an output portion which is distant from the axis member and which is adapted to reciprocate an object.

13. An apparatus according to claim 9, wherein the restoring device comprises:

a pivotable member which is supported by the frame such that the pivotable member is pivotable about an axis line thereof, the axis member being secured to the pivotable member such that the axis member is eccentric with the axis line of the pivotable member; and a torque applying device which includes an elastic member and which utilizes an elastic force of the elastic member for applying a torque to pivot the pivotable member toward a reference rotation position thereof corresponding to the reference position of the fulcrum portion of the swing link.

14. An apparatus according to claim 13, wherein the elastic member comprises a spring member whose one end portion is fixed to the pivotable member such that the spring member extends radially outwardly from the pivotable member, and whose other end portion is engaged with the frame.

15. An apparatus according to claim 9, wherein the axis member is fixed to the frame and the restoring device comprises an elastic member which is provided between the axis member and the fulcrum portion of the swing link.

16. A reciprocal apparatus, comprising:

a frame;

a reciprocative member which is supported by the frame such that the reciprocative member is reciprocatively moved relative to the frame;

a drive device which is supported by the frame and which is repetitively operated forward and backward such that the drive device is kept still for at least one of a first time duration between each of the repetitive forward operations thereof and a following one of the repetitive backward operations thereof and a second time duration between each of the repetitive backward operations thereof and a following one of the repetitive forward operations thereof;

a transmitting device which operatively connects the drive device and the reciprocative member to each other and which transmits a drive force of the drive device to the reciprocative member; and a vibration absorbing device which includes an elastic member which separates the transmitting device into a first portion on a side of the reciprocative member and a second portion on a side of the drive device, the elastic member absorbing vibration of a movable portion of the drive device and vibration of the second portion, so that vibration of the reciprocative member is smaller than the vibration of the movable portion that is temporarily produced when the drive device is stopped and kept still for said at least one of the first and second time durations.

17. A zigzag sewing machine, comprising:

a machine frame;

a needle bar which is supported by the machine frame such that the needle bar is reciprocatively moved in each of an axial direction thereof and a transverse direction thereof substantially perpendicular to the axial direction;

an electric motor which is supported by the machine frame and which is repetitively operated forward and backward such that the electric motor is kept still for at least one of a first time duration between each of the repetitive forward operations thereof and a following one of the repetitive backward operations thereof and a second time duration between each of the repetitive backward operations thereof and a following one of the repetitive forward operations thereof;

a transmitting device which operatively connects the electric motor and the needle bar to each other and which transmits a drive force of the electric motor to the needle bar so that the needle bar is reciprocatively moved in the transverse direction thereof; and a vibration absorbing device which includes an elastic member which separates the transmitting device into a first portion on a side of the needle bar and a second portion on a side of the electric motor, the elastic member absorbing vibration of the second portion and vibration of a movable portion of the electric motor, such that vibration of the needle bar in the transverse direction thereof is smaller than vibration of the movable portion that is temporarily produced in the transverse direction when the movable portion is stopped and kept still for said at least one of the first and second time durations.

18. A zigzag sewing machine according to claim 17, wherein the transmitting device comprises:

a rod which is supported by the machine frame such that the rod extends in a substantially horizontal direction and is movable in an axial direction thereof;

a needle-bar support frame which is connected to one of opposite end portions of the rod and which supports the needle bar such that the needle bar is movable in the axial direction thereof;

a swing link which is engaged via an axis member with the machine frame such that the swing link is swingable relative to the machine frame and which includes an output portion which is distant from the axis member and which is operatively connected to the other end portion of the rod; and a connecting device which connects an output portion of the movable portion of the electric motor, to an input portion of the swing link that is distant from the axis member, so as to transmit the driving force of the electric motor to the input portion of the swing link, and wherein the vibration absorbing device comprises a restoring device which is provided between the machine frame and a fulcrum portion of the swing link that is engaged with the axis member, which permits the fulcrum portion of the swing link to be moved from a reference position of the fulcrum portion, and which applies a restoring force to the fulcrum portion in a direction in which the fulcrum portion is moved back to the reference position thereof.

19. A zigzag sewing machine according to claim 18, wherein the restoring device comprises:

a pivotable member which is supported by the machine frame such that the pivotable member is pivotable about an axis line thereof, the axis member being secured to the pivotable member such that the axis member is eccentric with the axis line of the pivotable member; and a torque applying device which utilizes an elastic force of the elastic member for applying a torque to pivot the pivotable member toward a reference rotation position thereof corresponding to the reference position of the fulcrum portion of the swing link.

20. A zigzag sewing machine according to claim 17, wherein the transmitting device comprises:

a rod which is supported by the machine frame such that the rod extends in a substantially horizontal direction and is movable in an axial direction thereof;

a needle-bar support frame which is connected to one of opposite end portions of the rod and which supports the needle bar such that the needle bar is movable in the axial direction thereof;

a swing link which is engaged via an axis member with the machine frame such that the swing link is swingable relative to the machine frame and which includes an output portion which is distant from the axis member and which is operatively connected to the other end portion of the rod; and a connecting device which connects an output portion of the movable portion of the electric motor, to an input portion of the swing link that is distant from the axis member, so as to transmit the driving force of the electric motor to the input portion of the swing link, and wherein the vibration absorbing device comprises a restoring device comprises the elastic member which is provided between the output portion of the swing link and the other end portion of the rod.

21. A zigzag sewing machine according to claim 18, wherein the electric motor comprises, as the movable portion thereof, a rotor which is rotatable about an axis line thereof, and an output shaft which is rotatable with the rotor, and wherein the connecting device comprises a crank arm whose one end portion is fixed to the output shaft as the output portion of the movable portion and whose other end portion is connected to the input portion of the swing link such that the crank arm is pivotable about an axis line parallel to an axis line of the output shaft.

22. A zigzag sewing machine according to claim 21, wherein one of the swing link and the machine frame supports the axis member as a first axis member and the other of the swing link and the machine frame includes a first recessed portion which is engaged with the first axis member, wherein one of the other end portion of the crank arm and the input portion of the swing link supports a second axis member parallel to the axis line of the output shaft, and the other of the other end portion of the crank arm and the input portion of the swing link includes a second recessed portion which is engaged with the second axis member, and wherein one of the first and second recessed portions defines a circular hole having a circular cross section and the other of the first and second recessed portions defines an elongate recess which is elongate in a direction substantially parallel to a straight line perpendicular to each of the respective axis lines of the first and second axis members.

* * * * *